US007182677B2

(12) United States Patent
Donohue et al.

(10) Patent No.: US 7,182,677 B2
(45) Date of Patent: Feb. 27, 2007

(54) CHEMICAL MECHANICAL POLISHING PAD FOR CONTROLLING POLISHING SLURRY DISTRIBUTION

(75) Inventors: Timothy James Donohue, Menlo Park, CA (US); Venkata R. Balagani, Gilroy, CA (US); Romain Beau de Lomenie, Menlo Park, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 11/036,903

(22) Filed: Jan. 14, 2005

(65) Prior Publication Data

US 2006/0160478 A1 Jul. 20, 2006

(51) Int. Cl.
*B24B 5/00* (2006.01)

(52) U.S. Cl. ..... 451/287; 451/527; 451/530; 51/297

(58) Field of Classification Search ..... 451/527, 451/528, 530, 550, 551, 921, 287; 51/296, 51/297

See application file for complete search history.

(56) References Cited

U.S. PATENT DOCUMENTS 5,257,478 A 11/1993 Hyde et al.
5,489,233 A 2/1996 Cook et al.
5,578,362 A 11/1996 Reinhardt et al.
5,605,760 A 2/1997 Roberts
5,650,039 A 7/1997 Talieh
5,882,251 A * 3/1999 Berman et al. ..... 451/527
5,921,855 A 7/1999 Osterfield et al.
5,984,769 A 11/1999 Bennett et al.
6,159,088 A * 12/2000 Nakajima ..... 451/527
6,217,426 B1 4/2001 Tolles et al.
6,575,825 B2 6/2003 Tolles et al.
6,843,711 B1 * 1/2005 Muldowney ..... 451/527
6,955,587 B2 * 10/2005 Muldowney ..... 451/41
6,958,002 B1 * 10/2005 Palaparthi ..... 451/36

* cited by examiner

*Primary Examiner*—Jacob K. Ackun, Jr.
(74) *Attorney, Agent, or Firm*—Janah & Associates

(57) ABSTRACT

A polishing pad for a chemical mechanical polishing apparatus has a body with a polishing surface having a radius, a central region, and a peripheral region. The polishing surface has a plurality of main radial-line channels extending radially outwardly from the central region to the peripheral region, each main radial-line channel having an angled outer segment at the peripheral region that is directed at an angle relative to a radius of the polishing surface. The polishing surface also has a plurality of primary tributary radial-line channels that are each connected by an angled transition segment to a main radial-line channel, the tributary radial-line channels being spaced apart from the main radial-line channels. The polishing pad provides an improved distribution and flow of polishing slurry during a polishing process.

42 Claims, 8 Drawing Sheets

CHEMICAL MECHANICAL POLISHING PAD FOR CONTROLLING POLISHING SLURRY DISTRIBUTION

BACKGROUND

Figure 1:
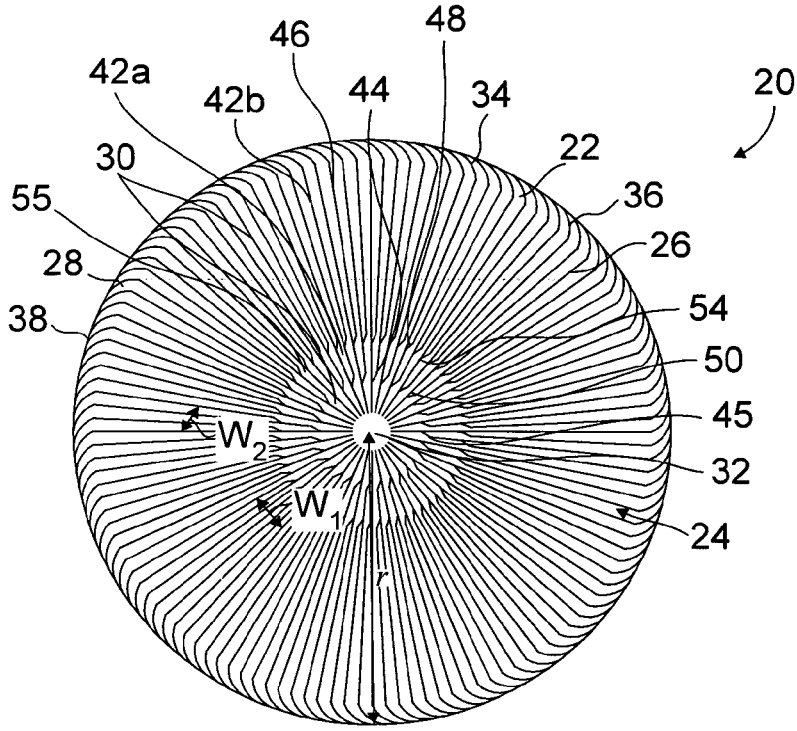

Embodiments of the present invention relate to a chemical mechanical polishing pad and related methods and apparatus.

Chemical mechanical planarization (CMP) is used to planarize the surface of a substrate, in the manufacture of the integrated circuits and displays. A typical CMP apparatus comprises a polishing head that oscillates and presses a substrate and polishing pad against one another, while a slurry of abrasive particle is supplied therebetween. CMP can be used to planarize the surfaces of dielectric layers, deep or shallow trenches filled with polysilicon or silicon oxide, metal films, and other such layers. It is believed that CMP polishing typically occurs as a result of both chemical and mechanical effects, for example, a chemically altered layer is repeatedly formed at the surface of the material being polished and then polished away. For instance, in the polishing of metal features or layers, a metal oxide layer is formed and then removed repeatedly from the surface of the metal being polished.

To control slurry distribution, the polishing pad surface typically has a pattern of perforations or grooves to control the distribution of polishing slurry across the substrate. CMP polishing results depend upon the chemical and mechanical interaction of the polishing surface of the polishing pad which is pressed against the substrate the polishing pad, the abrasive particles of the polishing slurry, and the reactive material of the substrate. A non-uniform distribution of polishing slurry across the substrate surface can result in uneven polishing of the substrate surface. Thus, it is desirable to have a polishing surface of the polishing pad capable of providing a uniform distribution of slurry across the substrate surface.

Several pad designs have been developed to provide more uniform polishing slurry distribution across the surface of the substrate. One pad design uses concentric circular grooves or spiral grooves, as for example, disclosed in commonly assigned U.S. Pat. No. 5,984,769 which is incorporated herein by reference in its entirety. The circular grooves fill with polishing slurry during the polishing process to maintain a more uniform distribution of polishing slurry across the substrate surface. While such pad designs improve overall polishing uniformity, they also tend to trap slurry in predefined regions of the polishing surface of the pad resulting in excessive polishing of corresponding substrate regions. Also, because the slurry is trapped in a closed circular groove, the polishing slurry is prevented from continuously flowing from the center of the pad to its outer edge, which is desirable to remove polishing byproduct and worn slurry particles. In another pad design, an X-Y grooving pattern is provided on the polishing surface with different channel lengths. However, when the polishing pad and substrate oscillated with a rotating motion, the X-Y pattern generates a polishing slurry flow imbalance due to the axial symmetry of the groove pattern, and can also result in slurry being rapidly ejected from the edge of the pad surface.

A further problem with conventional designs arises because the pad has to be both sufficiently rigid to planarize the substrate surface and sufficiently compliant to press the polishing pad with uniform pressure against the substrate surface. To properly planarize the substrate, the polishing pad should polish only the peaks and not the valleys of the surface topography of the substrate. However, if the polishing pad is too easily compressed under localized stresses applied at pad regions which are directly above peaks in the substrate topography, the substrate region that surrounds the peak becomes excessively polished, which is undesirable. The pad has to be sufficiently rigid so that it does not compress too much under the load applied by the topographic peaks on the substrate, and yet sufficiently flexible to conform to, and uniformly polish, a slightly warped substrate.

To address the simultaneous flexibility and rigidity requirements, polishing pads are typically fabricated with two stacked layers of different materials, the bottom layer being made of a compliant springy material and the top layer being made of a rigid material that serves as the polishing surface. However, in use, polishing slurry tends to wick into the interface between the two layers starting from the outer peripheral edge of a layer toward the center of the two layers. This wicking can cause undesirable changes in the compressibility of the compliant spring layer. Excessive wicking can also cause polishing slurry to penetrate deep enough between the layers to reach and change optical properties of a pad window in the pad. It is desirable to have a polishing pad that is compliant and springy as well as sufficiently rigid to serve as a polishing surface.

Accordingly, it is desirable to have a polishing pad with a polishing surface that provides uniform and repeatable planarization of substrates. It is further desirable to have patterned features on the polishing surface of the polishing pad that cause the slurry to be uniformly distributed across the substrate surface. It is further desirable to have a polishing pad that is compliant while still providing a substantially rigid polishing surface.

SUMMARY

In one version, a polishing pad for a chemical mechanical polishing apparatus has a body with a polishing surface having a radius and central and peripheral regions. The polishing surface has a plurality of main radial-line channels extending radially outwardly from the central to the peripheral region, each main radial-line channel having an angled outer segment at the peripheral region that is directed at an angle relative to a radius of the polishing surface. The polishing surface also has a plurality of primary tributary radial-line channels that are each connected by an angled transition segment to a main radial-line channel, the tributary radial-line channels being spaced apart from the main radial-line channels. The polishing pad provides an improved distribution and flow of polishing slurry during a polishing process.

In another version, the polishing pad has also a bottom surface opposite the polishing surface, with a pattern of pressure-load accommodating features that include a plurality of protrusions and depressions. The depressions are sized and shaped to accommodate a lateral expansion of the protrusions upon application of a pressure to the polishing surface.

The polishing pad can be used in a chemical mechanical apparatus which has a polishing station comprising a platen to hold the polishing pad and a support to hold a substrate against the polishing pad; a slurry dispenser to dispense slurry on the polishing pad; and a polishing motor to drive at least one of the platen and support to oscillate the polishing pad and substrate against one another.

In one method of fabrication, the polishing pad can be fabricated by cutting material from the polishing surface to form the main and tributary radial-line channels, at a cutting speed that is sufficiently high to heat the material in the main and tributary radial-line channels to a temperature that melts the material to substantially seal off the bottom of the channels.

In yet another version, a chemical mechanical polishing pad has a body having a polishing surface having a radius and central and peripheral regions. The polishing surface has a plurality of main radial-line channels extending radially outwardly from the central region to the peripheral region, each main radial-line channel having an angled outer segment at the peripheral region that is directed at an angle relative to a radius of the polishing surface. The length $L_1$ of the main-line radial channel, the length $L_2$ of the angled outer segment, and the angle $\alpha$ formed between the angled outer segment and main-line radial channel, are selected to provide a uniform distribution of polishing slurry across the substrate surface.

In still another version, the length $L_1$ of the main-line radial channel, the length $L_2$ of the angled outer segment, and the angle $\alpha$ formed between the angled outer segment and main-line radial channel are selected such that the centripetal force $F_c$ acting on the polishing slurry in the angled outer segment is controlled to provide a desired flow rate of slurry through the channel, where $F_c=mv^2/r$, m is a mass of the slurry in the channel, v is the velocity of the slurry, and r is the average radial distance of the angled outer segment across the polishing pad.

In one more version, the length $L_1$ of the main-line radial channel, the length $L_2$ of the angled outer segment, and the angle $\alpha$ formed between the angled outer segment and main-line radial channel are selected such that the centripetal force $F_c$ acting on the polishing slurry in the angled outer segment is balanced against an opposing force $F_o$ which acts on the slurry in the angled outer section of the channel to provide a desired flow rate of slurry through the channel, where $F_c=mv^2/r$, m is a mass of the slurry in the channel, v is the velocity of the slurry, and r the average radial distance of the angled outer segment across the polishing pad, and $F_o=mr(d\theta/dt)^2\cos(\alpha-(\pi/2))$, where, $d\theta/dt$ is the angular velocity of the polishing pad, and $\alpha$ is the angle between the main-line radial channel and angled outer segment.

DRAWINGS

Figure 5A:
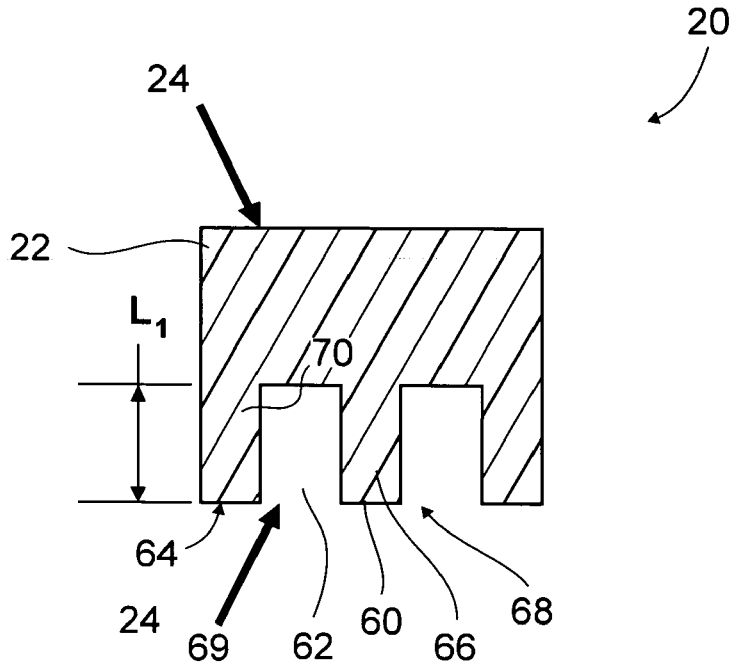
Figure 5B:
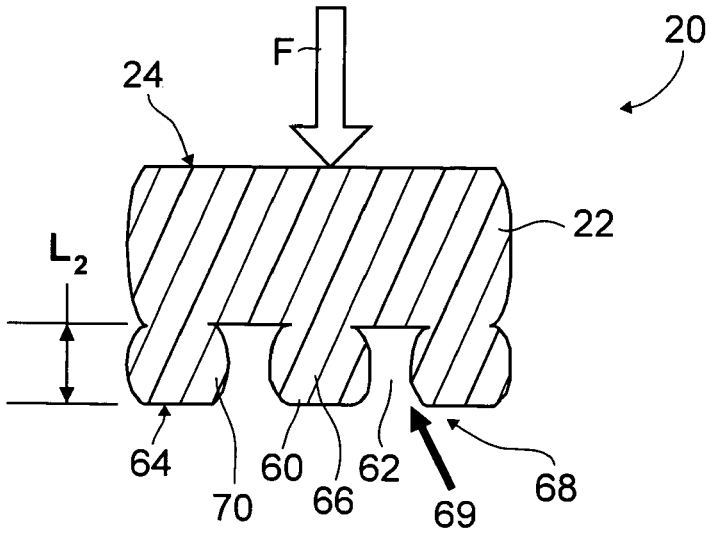
Figure 6A:
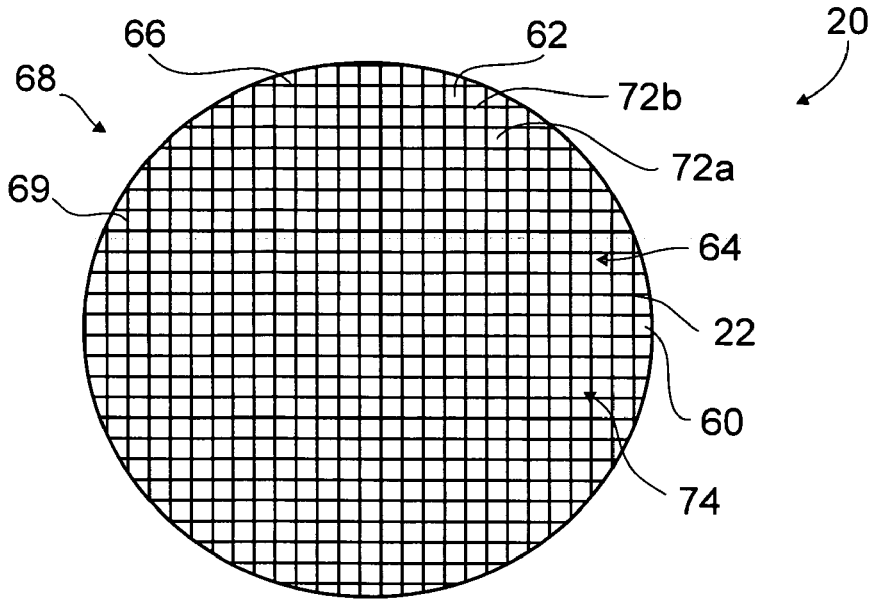
Figure 6B:
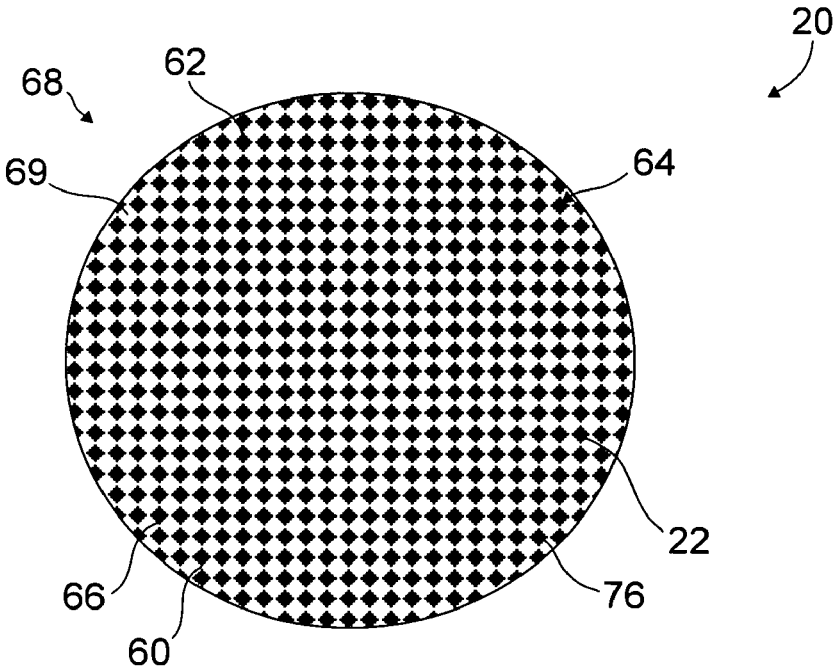
Figure 7A:
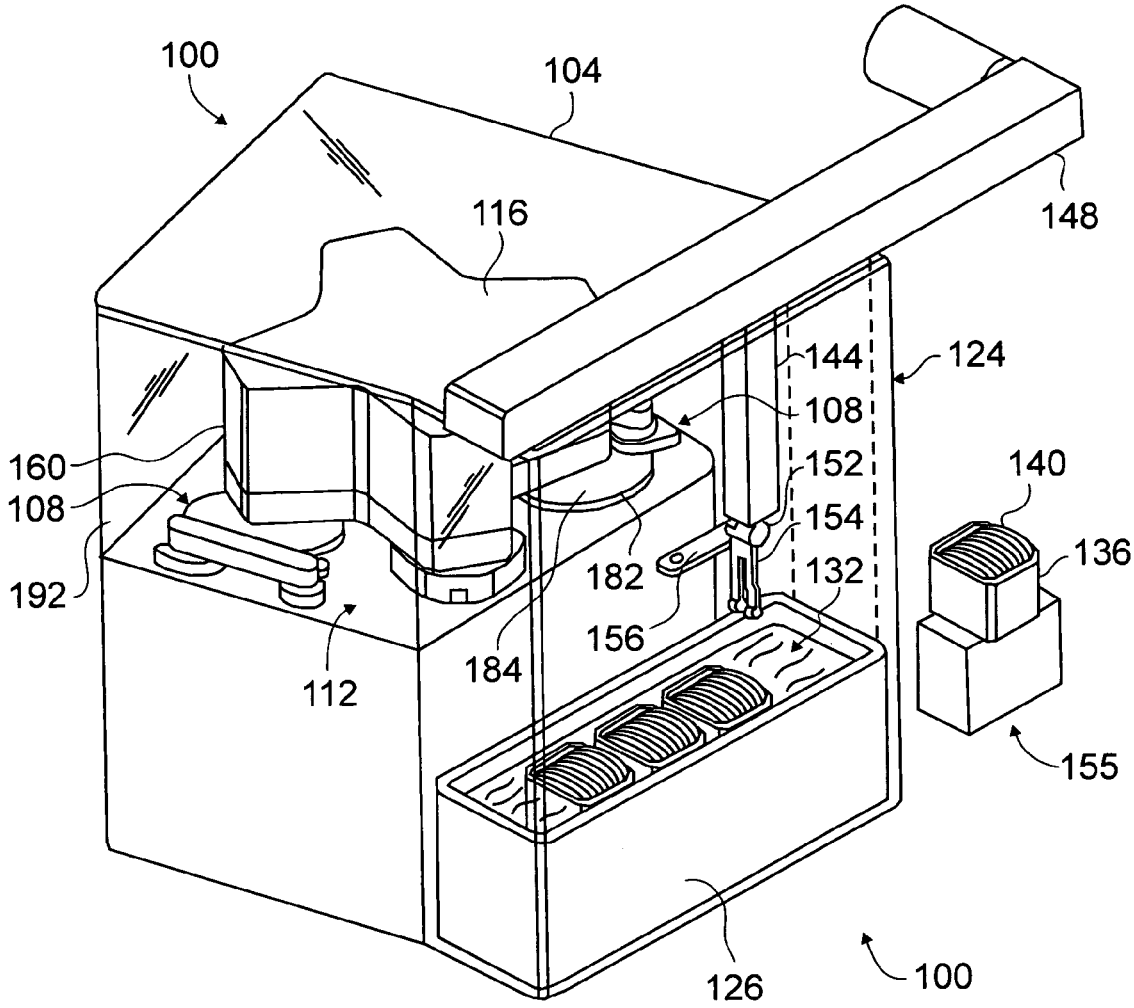
Figure 7B:
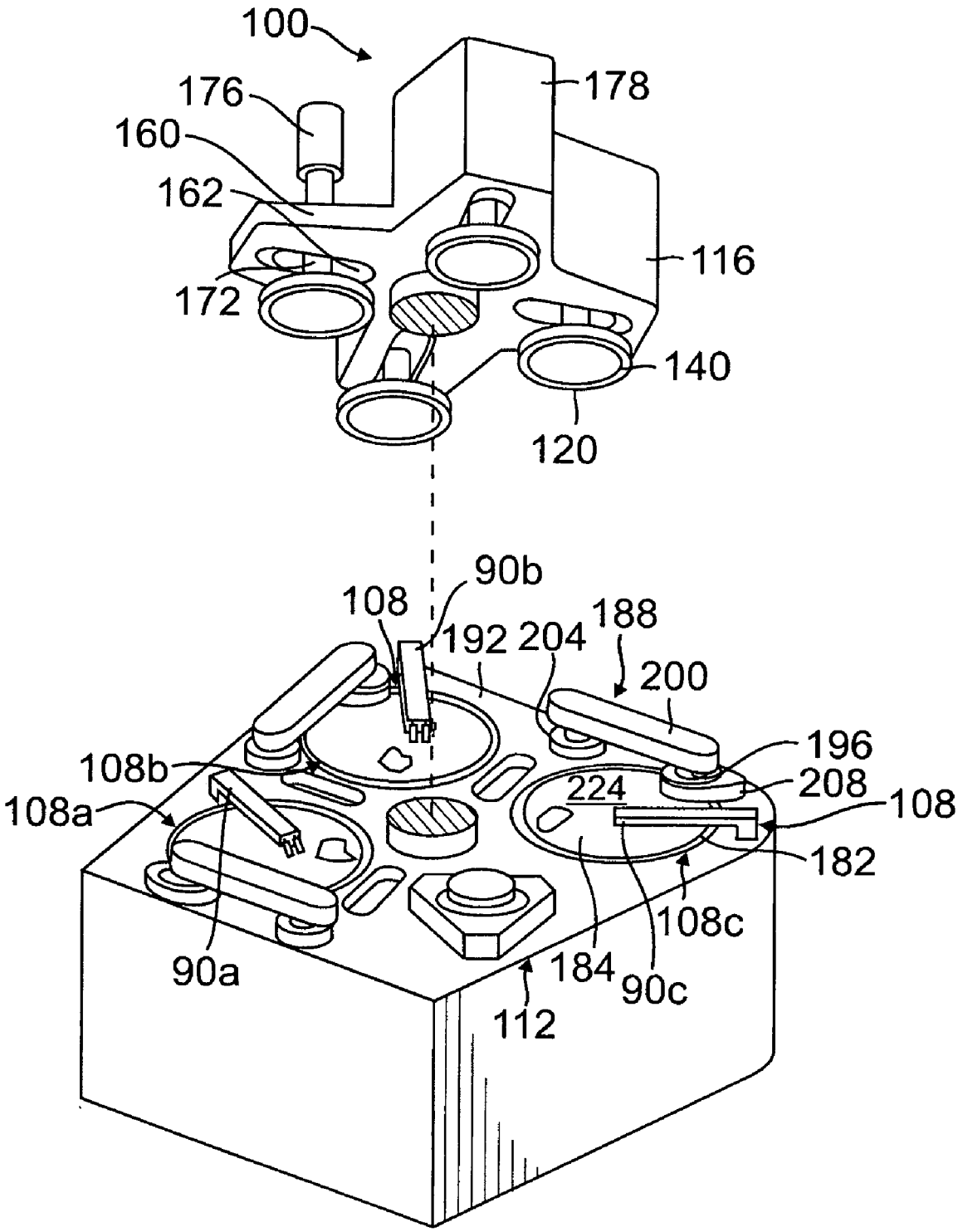

These features, aspects and advantages of the present invention will become better understood with regard to the following description, appended claims, and accompanying drawings, which illustrate examples of the invention. However, it is to be understood that each of the features can be used in the invention in general, not merely in the context of the particular drawings, and the invention includes any combination of these features, where:

FIGS. 1 through 4 are partial top views of embodiments of polishing pads comprising patterned polishing slurry grooves;

FIG. 5*a* is a partial sectional side view of an embodiment of a polishing pad having pressure load-accommodating features;

FIG. 5*b* is a partial sectional side view of the embodiment shown in FIG. 5*a* upon application of a load pressure;

FIGS. 6*a* and 6*b* are partial bottom views of embodiments of polishing pads having different patterns of pressure load-accommodating features;

FIG. 7*a* is a perspective view of an embodiment of a CMP polisher;

FIG. 7*b* is a partially exploded perspective view of the CMP polisher of FIG. 7*a;*

Figure 7C:
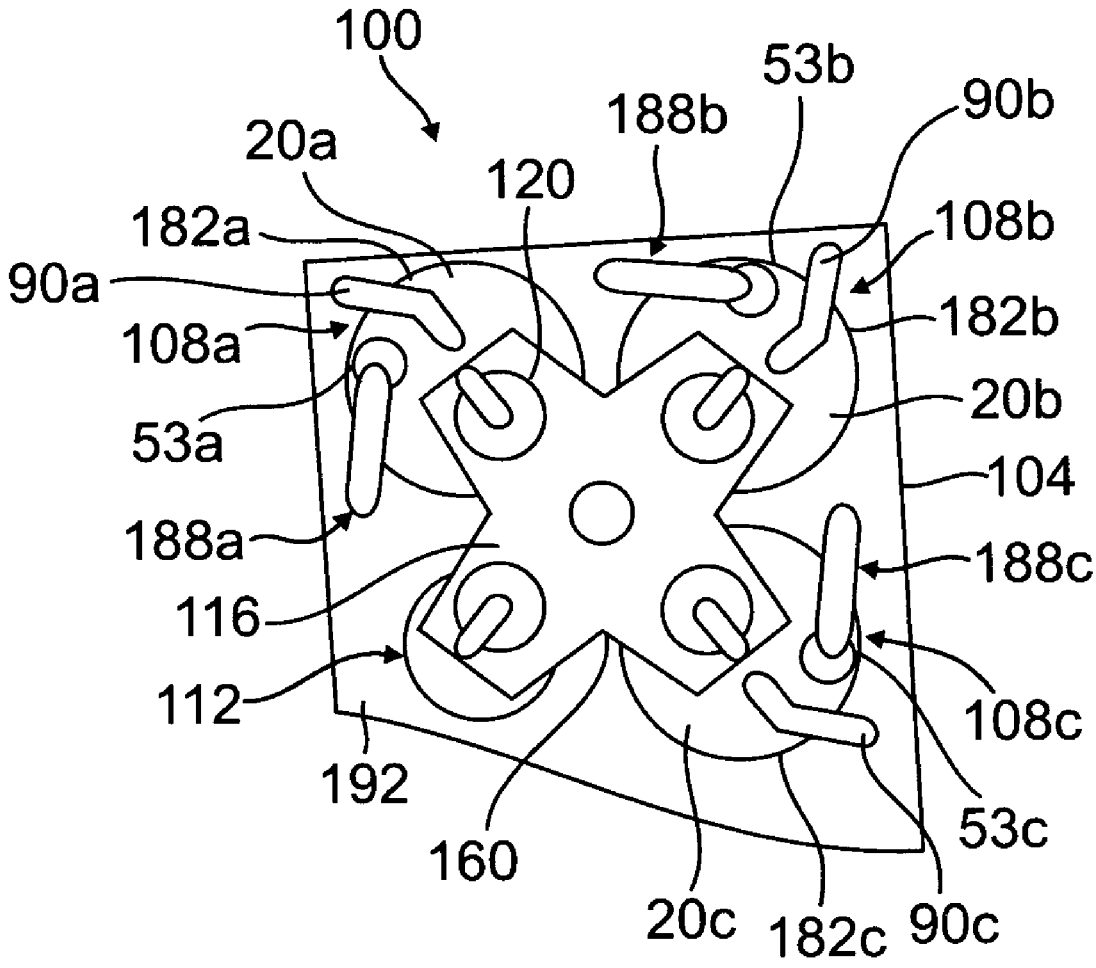
Figure 8A:
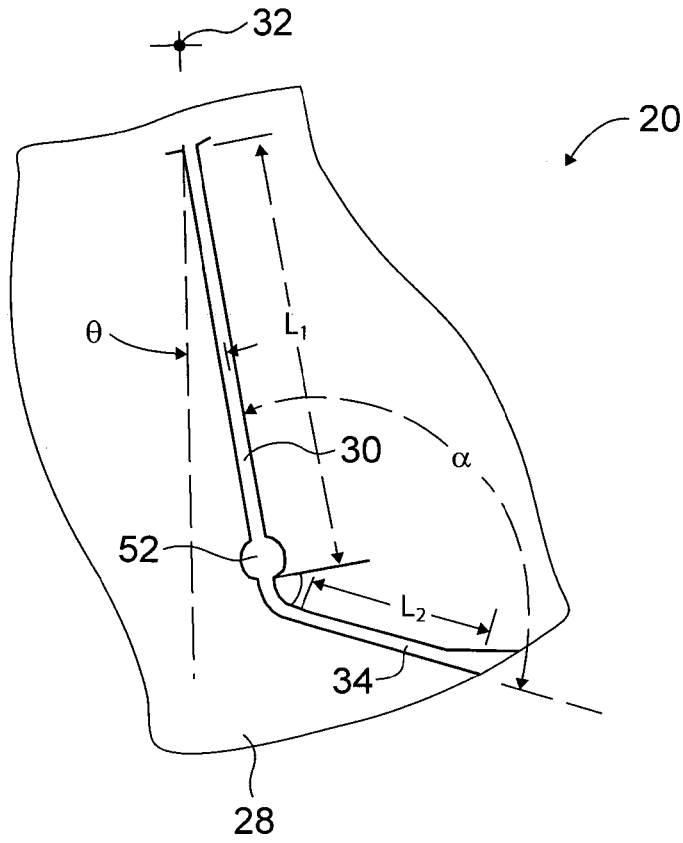
Figure 8B:
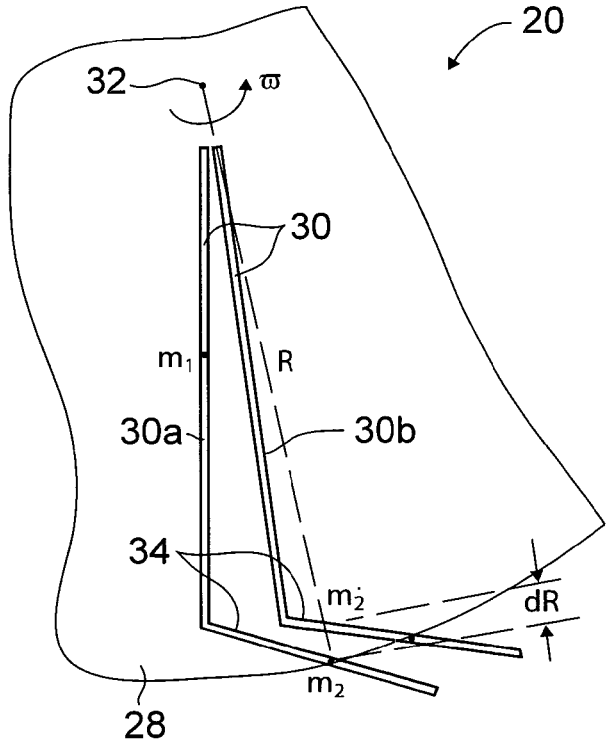

FIG. 7*c* is a diagrammatic top view of the CMP polisher of FIG. 7*b*; and FIGS. 8*a* and 8*b* are partial top views of embodiments of polishing pad surfaces having improved slurry flow channels.

DESCRIPTION

A polishing pad 20 for a chemical mechanical polishing apparatus (FIGS. 7*a*–7*b*) according to embodiments of the present invention comprises a pad body 22 having a polishing surface 24, as shown for example in FIG. 1. The polishing pad 20 typically comprises a planar circular body 22 having a disc-like shape and a radius that is sized to provide sufficient coverage of a substrate surface during polishing. For example the pad 20 may be at least several times larger than the substrate 140. The polishing surface 24 is adapted to contact and rotate against a substrate 140 to polish the substrate, for example by removing uneven topographical features from the substrate 140. The polishing surface 24 comprises a material that is sufficiently abrasive to polish and remove undesired material from the substrate 140, substantially without excessively scratching or otherwise damaging the substrate surface. For example, the polishing surface 24 of the polishing pad 20 may be made of a polymer, felt, paper, cloth, ceramic, or other such materials. A polishing slurry is flowed between the polishing surface 24 and the substrate 140 while they oscillate to chemically and mechanically polish the substrate 140. Suitable polishing slurries may comprise, for example, slurry particles comprising at least one of aluminum oxide, silicon oxide, silicon carbide, or other ceramic powders; suspended in a solution comprising for example, one or more of water, alcohol, buffering agents and suspension chemicals.

The polishing surface 24 of the polishing pad 20 comprises one or more grooves 26 formed therein to enhance the flow of the polishing slurry over the polishing surface 24, as shown for example in FIGS. 1 through 4. For example, the grooves 26 may provide a more homogeneous distribution of slurry across the surface 24, thereby providing more homogeneous polishing of a substrate 140. It has been discovered that an improved polishing surface 24 is provided by shaping the grooves 26 to provide a controlled distribution and flow rate of polishing slurry through the grooves 26. Examples of polishing surfaces 24 comprising such improved grooves 26 are shown in FIGS. 1 through 4. The grooves 26 are desirably shaped and sized to desirably provide a good distribution of polishing slurry across the polishing surface 24 during a substrate polishing process. The grooves 26 desirably also allow a desired amount of used slurry and slurry by-products to be released from the pad at a peripheral region 28 of the polishing surface 24 during a polishing process.

Figure 2:
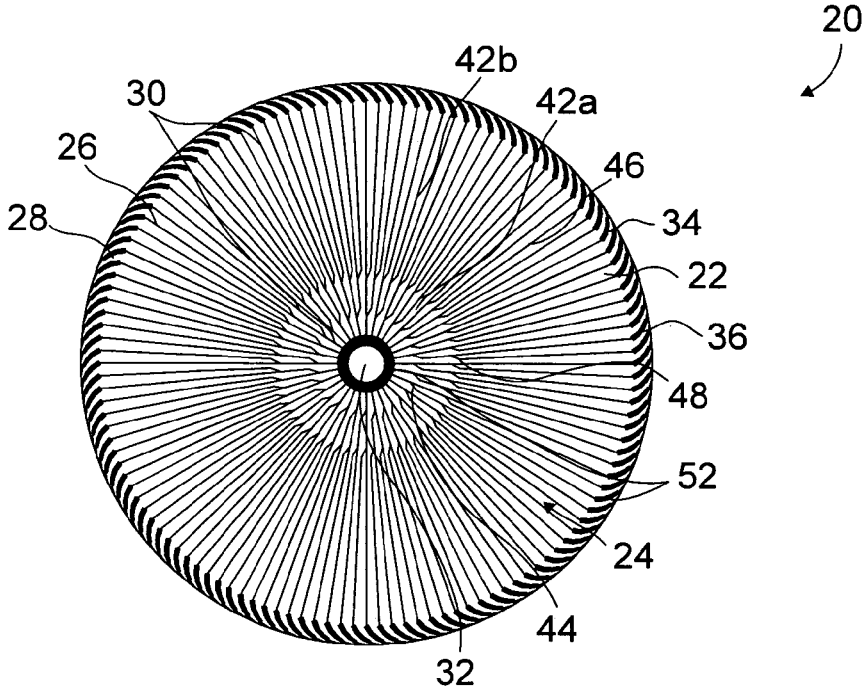
Figure 3:
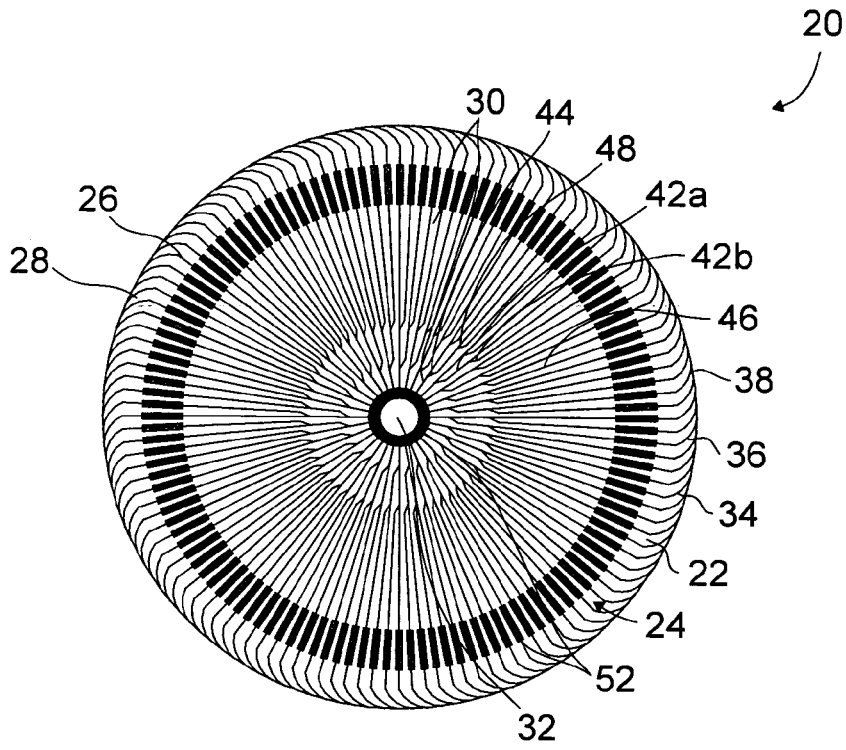
Figure 4:
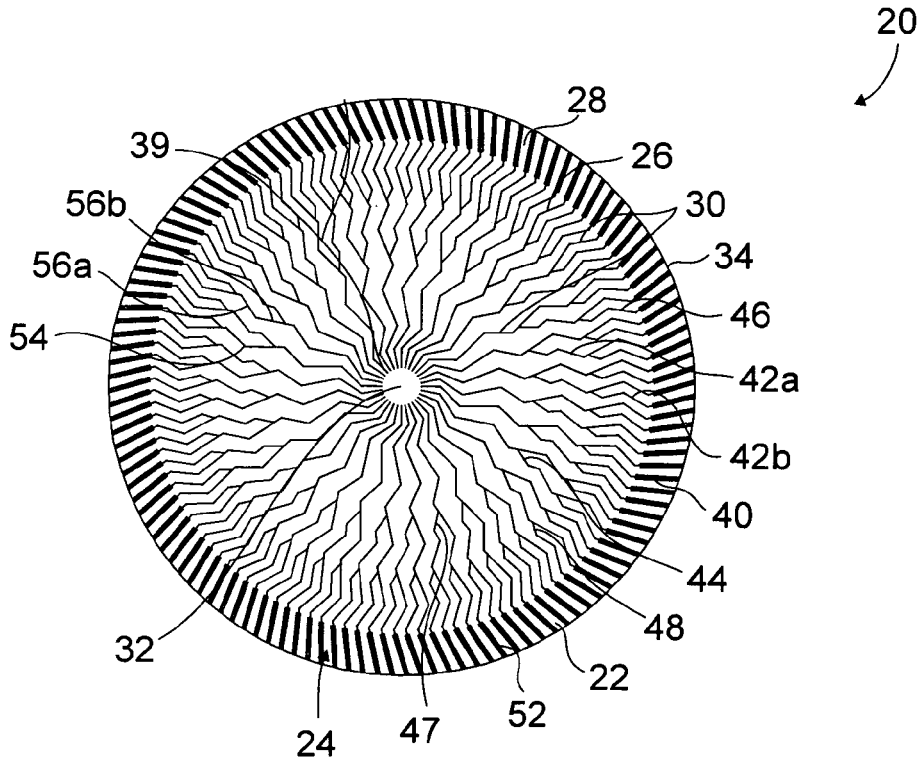

The improved grooves 26 comprise a plurality of main radial-line channels 30 extending radially outwardly from a central region 32 of the polishing pad 20, to the peripheral region 28 of the polishing pad, as shown for example in FIG. 1. The main radial-line channels 30 each extend along a radial line 39 representing a radius r of the polishing surface 24, and are spaced apart by a desired distance between the channels 30. In FIGS. 1 through 3, the channels 30 are substantially coincident with a radial-line. In FIG. 4, the channels 30 have an overall flow direction along radial-lines 39, but provide a convoluted polishing slurry flow that oscillates about the radial-lines 39. Upon rotation of the polishing surface 24, for example during polishing of a substrate 140, a polishing slurry applied to the main radial-line channels 30 is propelled out along the channels 30 and towards the peripheral region 28 of the polishing surface 24 by a centripetal force. Thus, the centripetal force caused by rotation of the polishing surface 24 results in a flow of polishing slurry through the main radial-line channels 30, thus distributing the polishing slurry about the polishing surface 24 from the interior of the pad to the pad periphery 38. The polishing pad 20 desirably comprises a sufficient number and density of the main radial-line channels 30 to distribute the polishing slurry along a plurality of radii on the polishing surface. For example, the polishing pad 20 can comprise from about 2 to about 12 of the main radial-line channels 30 across each 10 degree arc of the polishing surface 24.

The main radial-line channels 30 further comprise an angled outer segment 34 at the peripheral region 28 that is directed at an angle relative to the radial-line r of each main radial-line channel 30, as shown for example in FIG. 1. The angled outer segment 34 may comprise, for example, a tangential arc 36 that bends away in an arc away from main radial-line channel 30 while approaching a periphery 38 of the polishing surface 24, as shown for example in FIGS. 1, 2 and 3. The length and tangential angle of such a tangential arc 36 can be selected to provide the desired slurry flow characteristics. For example, the tangential arc 36 may sweep out an average tangential angle θ of from about 50 to about 60° from the radius r. The angled outer segment 34 may also comprise a substantially straight, non-arcing segment 40, that is bent way from the radial-line 39 of the main radial-line channel 30 such that the angled segment 34 approaches the periphery 38 of the polishing surface 24 at a substantially non-perpendicular angle, as shown for example in FIG. 4. For example, the segment 34 may be bent away from the radial-line 39 along which the main radial-line channel 30 runs, such that the angled outer segment 34 and main-line radial channel 30 form an angle α of from about 2 to about 45°, as shown for example in FIG. 8*a*.

The angled outer segments 34 are desirably curved or bent in a direction that coincides with the direction of rotation of the polishing surface 24 during substrate polishing to provide "impeller blade" type forces that slow the slurry flow to the desired rate. For example, In FIGS. 1 through 4, the polishing rotation direction is desirably counter-clockwise to control the rate of slurry flow through the angled outer segments 34 that are angled in a counter-clockwise direction. The length and size of the main radial line channels 30, as well the length, size and angle of the angled outer segments can also be selected to provide a desired slurry distribution and flow rate in relation to a desired polishing pad rotation speed during a polishing process. Conversely, cleaning of the polishing pad 20 to remove remaining amounts of polishing slurry may be effected by rotating the polishing pad in a direction opposite that used during the polishing process to promote the expulsion of the remaining polishing slurry from the polishing surface 24, for example in a clock-wise direction for the pads 20 of FIGS. 1 through 4.

The main radial-line channels 30 comprising the angled outer segments 34 provide improved control of the polishing slurry flow across the polishing surface 24. The angled outer segments 34 act to slow the flow of the slurry radially outwardly along the channels 30. During rotation of the polishing surface 24, the polishing slurry is propelled by a centripetal force towards the periphery 38 of the polishing surface 24. However, upon flowing into the angled outer segments 34, the centripetal force is counteracted by "impeller-like" forces pushing the polishing slurry in the opposite direction. The effect of the angled outer segments 34 on the flow of polishing slurry is diagrammatically shown in FIGS. 8*a* and 8*b*. As shown in FIG. 8*a*, the main-line radial channel 30 comprises a length $L_1$, the angled outer segment 34 comprises a length $L_2$, and the channel 30 and segment 34 are connected to form a drive angle α therebetween, where the lengths $L_1$ and $L_2$ and drive angle α can be selected to provide an opposing force of a desired magnitude, such that the flow of slurry through the main channel 30 comprises a desired rate. The centripetal force experienced by a mass of polishing slurry as it travels through the channel 30 is defined by $F_c=mv^2/r$, where m is the mass of the slurry, v is the velocity of the slurry on the pad, and r is the average radial distance of the slurry mass at a point on the polishing surface, which could be for example, the average radial distance of the angled segment containing the slurry mass across the polishing surface.

However, as the slurry enters the angled outer segment 34, the angle of the segment slows the flow of the slurry. The force opposing the flow of slurry though the angled outer segment 34 can be written as $F_o=mr(d\theta/dt)^2\cos(\alpha-(\pi/2))$, where r is the radius of the slurry mass on the polishing pad, dθ/dt is the angular velocity of the polishing pad, and α is the drive angle between the angled outer segment 34 and main-line radial channel. Thus, by selecting smaller drive angles α, the polishing slurry is induced to slow in the angled outer segment 34, whereas larger drive angles result in less slowing of the drive angle. Similarly, the lengths $L_1$ and $L_2$ can be selected to change the radius at which the angled segment begins, and thus change the flow rate of the polishing fluid through the slurry. In one version, the lengths $L_1$ and $L_2$ and the angle α may be selected to provide an opposing force that is substantially equal to the centripetal force, to counterbalance the force. Other opposing forces may also slow the flow of the polishing slurry through the angled sections, such as for example an opposing frictional force, or the opposing force of air entering the spinning segments 34 with a certain pressure.

The slowing action of the angular segments 34 can also be understood with respect to FIG. 8*b*. In this figure, main-line radial channels 30*a,b* are spaced apart by an angle of from about 1° to about 45°. A mass $m_1$ of polishing slurry travels according to a centripetal force exerted on the mass from a position in the main-radial-line channel 30 to a position near the peripheral region 28 of the pad in the angled outer segment 34, designated $m_2$. However, the rotation of the polishing pad results in an instantaneous change in channel position as the main-line radial channel 30*a* rotates into the position previously occupied by the neighboring main-line radial channel 30*b*, with the slurry mass $m_2$ experiencing a displacement dR along the radius R of the polishing pad that changes the position of the mass to the position $m_2'$ that is more remote from the peripheral region 28. This displacement is counterbalanced by the centripetal force, as described above. Accordingly, the angled outer segments 34 of the polishing pad result in slowing of the polishing slurry to provide a desired flow and distribution of the slurry in the channels. Other flow control features, such as for example slurry reservoirs 52 adapted to pool or collect slurry, can also be provided along the main-line channel 30 and/or angled segments, as shown for example in FIG. 8*a*.

In one version, the lengths $L_1$ and $L_2$ of the main-line radial channel 30 and angled outer segment 34, and the drive angle α therebetween, can be selected such that the flow rate of the polishing slurry is slowed to a net flow out of the angled segments 34 that does not waste slurry. While the slurry flow rate is desirably slow, the flow rate may also be desirably greater than zero, such that used slurry and slurry by-products can be spun off of the polishing surface 24 to provide a fresh surface. Thus, the main radial-line channels 30 comprising the angled outer segments 34 provide an improved flow of polishing slurry through the channels 30 that maintains a desired level of polishing slurry in the channels 30, substantially without trapping the slurry on the polishing surface 24, such that used slurry and slurry by-products can be spun off of the polishing surface 24.

The distribution and flow of the polishing slurry on the polishing surface 24 can be further enhanced by providing a plurality of primary tributary radial-line channels 42 that are each connected by an angled transition segment 44 to a main radial-line channel 30. The transition segment 44 may comprise, for example, a curved segment 45, as shown for example in FIGS. 1, 2 and 3, that curves at an angle away from the main channel 30, and may also comprise a substantially straight segment 47 that is angled away from the main radial-line channel 30, as shown for example in FIG. 4. The primary tributary radial-line channels 42 can have portions that are be substantially parallel to portions of the main radial-line channels 30 to provide a more evenly distributed flow of polishing slurry over the polishing surface 24. The primary tributary radial-line channels 42 may also comprise angled outer segments 34 that help to control the flow of polishing fluid in the tributary channels 42. The transition segment 44 may act similarly to the angled outer segments 34, by opposing an excessive flow of polishing slurry into the primary tributary radial-line channels 42. For example, the transition segment 44 may allow only from about 5% to about 75% of the polishing slurry flow to pass into the primary tributary radial-line channels 42, to provide a controlled flow rate of slurry through the main radial-line channels 30 and primary tributary radial-line channels 42.

The primary tributary radial-line channels 42 are spaced apart from the main channels 30 at a distance that is selected to improve the slurry flow distribution over the polishing surface 24. For example, the primary tributary radial-line channels 42 may bisect regions where the distance between adjacent main channels becomes too great to provide a desired polishing slurry distribution. The number and density of the primary tributary radial-line channels 42 is furthermore selected to provide a desired distribution of polishing slurry across the polishing surface 24. For example, the polishing surface 24 can comprise from 1 to 10 primary tributary radial-line channels 42 across each 10 degree arc of the polishing surface 24. The main channels 30 may also comprise from 1 to 10 primary tributary radial-line channels 42, such as 2 primary tributary radial-line channels 42 as shown for example in FIGS. 1 through 4.

In one version, the polishing surface 24 further comprises a plurality of secondary tributary radial-line channels 46 each connected to a primary tributary radial-line channel 46 by a second transition section 48, such as a curved or otherwise angled transition section. The secondary tributary radial-line channels 46 may further distribute the flow of polishing slurry over the polishing surface 24, and may be sized and shaped to provide further control of the overall flow rate of the polishing slurry from the central region 32 to the peripheral region 28. In one version, the polishing surface 24 comprises from 1 to 10 secondary tributary channels across each 10 degree arc of the polishing surface 24.

Each main radial-line channel 30 may further comprise a plurality of primary tributary radial line channels 42 that branch off of the main channel 30 at different lengths along the radius of the polishing surface 24. For example, as shown in FIG. 1, the main channels 30 comprise a first primary tributary radial-line channel 42*a* that branches away from the main channel 30 at a first branch point 50 at a first radius, and a second primary tributary radial-line channel 42*b* that branches away from the main channel 30 at a second branch point 55 at a second radius that is further from the central region 32 of the polishing pad 20 than the first branch point 50. For example, the first branch point 50 may arise at a first radius that is from about 5 to about 60% of the total radius, and the second branch point 55 may arise at a second radius that is from about 30 to about 95% of the total radius of the pad. The first primary tributary radial-line channel 42*a* shown in FIG. 1 further comprises a secondary tributary radial-line channel 46 that branches off of the primary tributary 42 at a third branch point 51 that is at about the same radius as the second branch point 55, although the third branch point may also arise at a different radius. Thus, the main channel 30 and tributaries 42*a,b*, and 46 provide a good distribution of polishing slurry flow over the polishing surface 24. The length of the channels 30, 42*a,b*, 46 before and between the branch points 50,54,55, and the angle and length of the transition segments 44 can be selected, for example, in relation to the speed at which the polishing surface 24 is rotated during polishing, to provide a substantially uniform distribution of polishing slurry across the polishing surface 24.

The widths between the main and tributary channels 30, 42, 46 can furthermore be selected to provide an improved distribution of polishing slurry. For example, a ratio of a width $w_1$ between main radial-line channels 30 to a width $w_2$ between a main radial-line channel 30 and a primary tributary radial-line channel 42 at the same radius on the surface 24 may be from about 1 to about 30. Furthermore, the widths of the channels themselves may be selected to provide the desired polishing slurry flow characteristics. In one version, the main radial-line channels 30 may comprise a width that is greater than the tributary channels to accommodate a greater flow of polishing slurry therein. For example, a ratio of a width of the main radial-line channel 30 to a width of a primary tributary radial line channel 42 may be at least about 2:1, such as from about 3:1 to about 6:1. In one version, the lengths and widths of the grooves 26, including the main and tributary radial line channels 40,42,46 are selected to provide a volume of polishing slurry in the channels of typically from about 1 ml to about 300 ml, however, other volumes are also desirable depending on the application.

At least one of the width and depth of the main and tributary channels 30, 42, 46 may furthermore be varied over the length of the channels to provide the desired polishing slurry flow characteristics. For example, at least one of the width and depth of the channels may be increased in a certain region of the channel to provide a reservoir 52 of polishing fluid at that region. In one version, a width of a channel is increased by at least about 2 times to provide a slurry reservoir 52 in a region of the channel. The slurry reservoir 52 can provide desired slurry flow characteristics, and can inhibit the depletion of slurry in critical regions of the polishing surface 24. In the version shown in FIG. 2, slurry reservoirs 52 are provided at the ends of the main and tributary channels 30,42,46 at a peripheral region 28 of the polishing surface 24, to inhibit excessive loss of polishing slurry from the surface 24 due to rotational motion of the polishing pad 20. A slurry reservoir 52 is also provided towards the central region 32 of the polishing surface 24, at the beginning of the channels 30,42,46, and comprises a volume that is sufficient to act as a slurry manifold for supplying the channels 30,42,46 with polishing slurry. In FIG. 3, slurry reservoirs 52 are provided in a region that is between the peripheral region 28 and the central region 32, to slow the slurry flow as is travels towards the periphery 38 of the polishing pad 20, and a slurry reservoir 52 is also provided towards a central region 32 of the polishing surface 24.

FIG. 4 shows yet another embodiment of a polishing pad surface 24 having main and tributary radial line channels 30,42,46. In this version, the main and tributary radial line channels 30,42,46 comprise a convoluted path that oscillates about a radial-line 39 from a central region 32 of the polishing surface 24 to a peripheral region 28 of the polishing surface 24. The convoluted path can comprise a series of angled interior segments 56*a,b* connected by turns 54 that redirect the polishing slurry from one segment 56*a* to another 56*b* about a given radial line 39, for example to form the "zig-zag" shape shown in FIG. 4. The angled interior segments 56*a,b* may comprise angles with respect to each other of, for example, from about 2 to about 60°. The angled segments 56*a,b* slow and control the flow of fluid along the channels 30,42,46 to provide the desired flow, and the length, angle and frequency of the angled interior segments 56*a,b* can be selected to according to the desired flow rate. FIG. 4 further shows slurry reservoirs 52 at the end of each channel 30,42,46 in the peripheral region 28 of the polishing pad 20 to slow the flow of the slurry in these regions.

The grooves 26 comprising the main and tributary radial line channels can be formed by suitable methods, such as for example by using a cutting tool to cut away pad material from the polishing surface 24 to form the grooves 26. In one version, the method of forming the grooves improves the flow of polishing slurry through the grooves 26. For example, the cutting tool may be operated with parameters that heat the polishing pad material in the grooves 26 to a temperature that is sufficient to effect a beneficial structural change in the pad material. The increased temperature desirably substantially seals surfaces 58 in the grooves 26, for example by substantially sealing exposed pores in the pad material of the grooves 26, to inhibit the infiltration of polishing slurry into the pores. Thus, the heat treated grooves 26 absorb less of the polishing slurry into the pad material, thereby improving the flow of the slurry through the grooves 26. In one version, the cutting tool may be operated to heat the pad material in the grooves 26 by employing a cutting speed of the cutting tool that is sufficient to heat the pad material to the desired temperature while simultaneously cutting the desired groove shapes. A temperature sufficient to substantially seal the surfaces 58 of the grooves may be at least about 100° C.

In yet another version, an improved polishing pad 20 is tailored to provide good pressure loading capacity, as shown for example in FIGS. 5*a* and 5*b*. In this version, a back side 60 of the pad 20 that is opposite to the polishing surface 24 comprises a pattern 68 of pressure-load accommodating features 69 that are formed in the back surface 64 of the polishing pad 20. The features 69 comprises a plurality of recesses 62 that have been cut out of or otherwise formed in a back surface 64 of the polishing pad 20, and a plurality of raised protrusions 66 about the recesses 62, such as a plurality of raised mesas. The plurality of recesses 62 and protrusions 66 are sized and shaped to accommodate pressure loading experienced by the pad 20 during polishing processes. For example, as shown in FIGS. 5*a* and 5*b*, the features 69 may be sized and shaped such that a lateral expansion of the raised features 66 during a polishing process, for example resulting from a pressure of the substrate 140 against the polishing surface 24, is accommodated by the space provided by the recesses 62. The raised features 66 can be vertically compressed by the polish pressure loading from a first length $L_1$ shown in FIG. 5*a* to a second smaller length $L_2$ shown in FIG. 5*b*, forcing the sidewalls 79 of the protrusions 66 to bulge into the adjacent recesses 62. A width of the recesses 62 formed in the back surface 64 that is suitable to accommodate the lateral expansion of the protrusions upon application of a pressure to the polishing surface 24 during a polishing process may be from about 1 mm to about 100 mm, and a suitable depth of the recesses 62 in the back side 60 of the polishing pad 20 may be from about 1 mm to about 25 mm.

The improved pressure-load accommodating pattern of features 69 allows for pressure loading of the pad 20 utilizing a single body 22 of pad material as opposed to a stacked body comprising different materials. This is because the pattern of features 69 is capable of providing the desired compliance and spring while still maintaining a sufficiently rigid polishing surface 24. Thus the polishing pad 20 does not require an extra layer of relatively more compliant and springy material below the relatively rigid material used for the polishing surface 24 to provide the desired pressure load accommodation, and is not subject to problems such as the wicking of slurry fluid between such stacked polishing pad layers. In one version, the recesses 62 are open to atmospheric pressure, and dampening of the polishing pressure is achieved primarily through the compression of the protrusions 66. In another version, the recesses 62 can be hermetically sealed to provide pockets of entrapped air in the recesses 62 that act as a dampening mechanism when compressed.

FIGS. 6*a* and 6*b* provide examples of polishing pads 20 comprising back sides 60 having a pattern 68 of pressure-load accommodating features 69 formed in the back surfaces 64 of the pad back sides 60. In FIG. 6*a*, the pattern of features 69 comprises a grid 74 of square-like raised protrusions 66 separated by recesses 62 comprising recessed grid-like lines 72*a,b*. The recesses 62 comprise a plurality of horizontal and vertical lines 72*a,b* that extend across the back surface 64, and that perpendicularly intersect one another to form the grid pattern. Alternatively, the grid lines 72*a,b* may extend across the back surface 24 in other patterns, such as for example along radial lines. The protrusions 66 laterally expand into the horizontal and vertical grid-like lines upon application of a polishing pressure. The protrusions 66 may each comprise a width of from about 1 mm to about 100 mm. The grid-like lines 72*a,b* may comprise a width of from about 1 mm to about 100 mm, a depth of from about 1 mm to about 25 mm, and a length that extends across the polishing pad 20. In FIG. 6*b*, the recesses 62 comprise square-like holes 76 where pad material has been cut out of the back surface 24. The holes 76 are cut in a checkerboard fashion, leaving square-like raised protrusions 66 alternating in between the holes 76. The protrusions comprise a width of from about 1 mm to about 100 mm and the holes 76 comprise a width of from about 1 mm to about 100 mm, and a depth of from about 1 mm to about 25 mm. The patterns of pressure load accommodating features 69 described above are capable of providing a desired compliance and springiness of the polishing pad by allowing for compression of the raised features 66. Patterns of recesses 62 and protrusions 66 other than those specifically described may also be formed to provide the desired polishing properties. For example, the pressure-load accommodating pattern 68 may comprise a uniform or non-uniform distribution of protrusions 66 and recesses 62 across the back surface 64, according to the desired polishing parameters. The pattern 68 may also comprise one or more of "x-y" grooving, recessed holes, concentric circular grooves, concentric arcs or a combination thereof.

The polishing pad 20 described herein can be used in any type of CMP polisher; thus, the CMP polisher described herein to illustrate use of the polishing pad 20 should not be used to limit the scope of the present invention. One embodiment of a chemical mechanical polishing (CMP) apparatus 100 capable of using the polishing pad 20 is illustrated in FIGS. 7A to 7C. The CMP apparatus 100 may be, for example, a Mire® CMP System from Applied Materials, Inc., Santa Clara, Calif. Generally, the polishing apparatus 100 includes a housing 104 containing multiple polishing stations 108*a–c*, a substrate transfer station 112, and a rotatable carousel 116 that operates independently rotatable substrate holders 120. A substrate loading apparatus 124 includes a tub 126 that contains a liquid bath 132 in which cassettes 136 containing substrates 140 are immersed, is attached to the housing 104. For example, the tub 126 can include cleaning solution or can even be a megasonic rinsing cleaner that use ultrasonic sound waves to clean the substrate 140 before or after polishing, or even an air or liquid dryers. An arm 144 rides along a linear track 148 and supports a wrist assembly 152, which includes a cassette claw 154 for moving cassettes 136 from a holding station 155 into the tub 126 and a substrate blade 156 for transferring substrates from the tub 126 to the transfer station 112.

The carousel 116 has a support plate 160 with slots 162 through which the shafts 172 of the substrate holders 120 extend, as shown in FIGS. 7A and 7B. The substrate holders 120 can independently rotate and oscillate back-and-forth in the slots 162 to achieve a uniformly polished substrate surface. The substrate holders 120 are rotated by respective motors 176, which are normally hidden behind removable sidewalls 178 of the carousel 116. In operation, a substrate 140 is loaded from the tub 126 to the transfer station 112, from which the substrate is transferred to a substrate holder 120 where it is initially held by vacuum. The carousel 116 then transfers the substrate 140 through a series of one or more polishing stations 108*a–c* and finally returns the polished substrate to the transfer station 112.

Each polishing station 108*a–c* includes a rotatable platen 182*a–c*, which supports a polishing pad 20*a–c*, and a pad conditioning assembly 188*a–c*, as shown in FIG. 7B. The platens 182*a–c* and pad conditioning assemblies 188*a–c* are both mounted to a table top 192 inside the polishing apparatus 100. During polishing, the substrate holder 120 holds, rotates, and presses a substrate 140 against a polishing pad 20*a–c* affixed to the rotating polishing platen 182, which also has a retaining ring encircling the platen 182 to retain a substrate 140 and prevent it from sliding out during polishing of the substrate 140. As a substrate 140 and polishing pad 20*a–c* are rotated against each other, measured amounts of a polishing slurry of, for example, deionized water with colloidal silica or alumina, are supplied according to a selected slurry recipe, for example by a polishing slurry dispenser 90*a–c*. Both the platen 182 and the substrate holder 120 can be programmed to rotate at different rotational speeds and directions according to a process recipe.

Each pad conditioning assembly 188 of the CMP apparatus 100 includes a conditioner head 196, an arm 200, and a base 204, as shown in FIGS. 7B and 7C. A pad conditioner 50 is mounted on the conditioner head 196. The arm 200 has a distal end 198*a* coupled to the conditioner head 196 and a proximal end 198*b* coupled to the base 204, which sweeps the conditioner head 196 across the polishing pad surface 24 so that the conditioning face of the pad conditioner 53 *a–c* conditions the polishing surface 24 of the polishing pad 20 by abrading the polishing surface to remove contaminants and retexturize the surface. Each polishing station 108 also includes a cup 208, which contains a cleaning liquid for rinsing or cleaning the pad conditioner 50 mounted on the conditioner head 196.

The present invention has been described with reference to certain preferred versions thereof; however, other versions are possible. For example, the pad conditioner can be used in other types of applications, as would be apparent to one of ordinary skill, for example, as a sanding surface. Other configurations of the CMP polisher can also be used. Furthermore, alternative channel configurations equivalent to those described can also be used in accordance with the parameters of the described implementation, as would be apparent to one of ordinary skill. Therefore, the spirit and scope of the appended claims should not be limited to the description of the preferred versions contained herein.

What is claimed is:

1. A chemical mechanical polishing pad comprising:

(a) a body comprising a polishing surface having a radius and central and peripheral regions, the polishing surface comprising:

(i) a plurality of main radial-line channels extending radially outwardly from the central region to the peripheral region, each main radial-line channel having an angled outer segment at the peripheral region; and (ii) a plurality of primary tributary radial-line channels that are each connected by an angled transition segment to a main radial-line channel, the primary tributary radial-line channels being spaced apart from the main radial-line channels.

2. A polishing pad according to claim 1 wherein the primary tributary radial-line channels comprise portions which are substantially parallel to portions of the main radial-line channels.

3. A polishing pad according to claim 1 further comprising a plurality of secondary tributary radial-line channels each of which is connected by second angled transition segment to a primary tributary radial-line channel.

4. A polishing pad according to claim 3 wherein the length and branch point of the primary and secondary tributary radial-line channels are selected in relation to the speed of use of the polishing pad such that a uniform distribution of polishing slurry is provided across the polishing pad surface.

5. A polishing pad according to claim 1 wherein the angled outer segments form tangential arcs that comprise an average tangential angle of from about 5° to about 60°.

6. A polishing pad according to claim 1 wherein the main radial-line channels comprise a plurality of angled interior segments that comprise angles relative to each other of from about 2 to about 45°.

7. A polishing pad according to claim 1 comprising from 1 to 10 main radial-line channels across each 10 degree arc of the polishing surface.

8. A polishing pad according to claim 7 comprising from 1 to 10 primary tributary radial-line channels across each 10 degree arc of the polishing surface.

9. A polishing pad according to claim 8 comprising from 1 to 10 secondary tributary radial-line channels across each 10 degree arc of the polishing surface.

10. A chemical mechanical apparatus comprising the polishing pad of claim 1, and further comprising:

(i) a polishing station comprising a platen to hold the polishing pad and a support to hold a substrate against the polishing pad;

(ii) a slurry dispenser to dispense slurry on the polishing pad; and (iii) a polishing motor to drive at least one of the platen and support to oscillate the polishing pad and substrate against one another.

11. A method of fabricating the polishing pad of claim 1, the method comprising:

(a) cutting material from the polishing surface to form the main and tributary radial-line channels, wherein the material is cut at a cutting speed that is sufficiently high to heat the material in the main and tributary radial-line channels to a temperature that melts the material and substantially seals off the bottom of the channels.

12. A chemical mechanical polishing pad comprising:

(a) a body comprising:

(i) a polishing surface having a radius, a central region and a peripheral region, the polishing surface comprising a plurality of main radial-line channels extending radially outwardly from the central region to the peripheral region, each main radial-line channel having an angled outer segment at the peripheral region that is directed at an angle relative to a radius of the polishing surface, and a plurality of primary tributary radial-line channels that are each connected by an angled transition segment to a main radial-line channel; and (ii) a bottom surface opposite the polishing surface, the bottom surface comprising a pattern of pressure-load accommodating features, the features comprising a plurality of protrusions and depressions, wherein the depressions are sized and shaped to accommodate a lateral expansion of the protrusions upon application of a pressure to the polishing surface.

13. A polishing pad according to claim 12 wherein the pattern of features comprises a grid of protrusions separated by a plurality of vertical and horizontal line depressions.

14. A polishing pad according to claim 12 wherein the pattern of features comprises a plurality of raised protrusions alternating with holes.

15. A chemical mechanical apparatus comprising the polishing pad of claim 12, and further comprising:

(i) a polishing station comprising a platen to hold the polishing pad and a support to hold a substrate against the polishing pad;

(ii) a slurry dispenser to dispense slurry on the polishing pad; and (iii) a polishing motor to drive at least one of the platen and support to oscillate the polishing pad and substrate against one another.

16. A method of fabricating the polishing pad of claim 12, the method comprising:

(a) cutting material from the polishing surface to form the main and tributary radial-line channels, wherein the material is cut at a cutting speed that is sufficiently high to heat the material in the main and tributary radial-line channels to a temperature that melts the material and substantially seals off the bottom of the channels.

17. A chemical mechanical polishing pad comprising:

(a) a body comprising a polishing surface having a radius and central and peripheral regions, the polishing surface comprising:

(i) a plurality of main radial-line channels extending radially outwardly from the central to the peripheral region of the polishing surface, each main radial-line channel having an angled outer segment at the peripheral region that is directed at an angle relative to a radial line of the polishing surface, the main-line radial channels and angled outer segments being adapted to flow a polishing slurry therethrough, wherein the length $L_1$ of the main-line radial channel, the length $L_2$ of the angled outer segment, and the angle $\alpha$ formed between the angled outer segment and main-line radial channel, are selected to provide a uniform distribution of polishing slurry across the substrate surface; and (ii) a plurality of primary tributary radial-line channels that are each connected by an angled transition segment to a main radial-line channel, the primary tributary radial-line channels being spaced apart from the main radial-line channels.

18. A polishing pad according to claim 17 further comprising a plurality of secondary tributary radial-line channels each of which is connected by second angled transition segment to a primary tributary radial-line channel.

19. A polishing pad according to claim 18 wherein the length and branch point of the primary and secondary tributary radial-line channels are selected in relation to the speed of use of the polishing pad such that a uniform distribution of polishing slurry is provided across the polishing pad surface.

20. A polishing pad according to claim 18 comprising from 1 to 10 main radial-line, primary tributary radial-line, or secondary tributary radial-line channels across each 10 degree arc of the polishing surface.

21. A polishing pad according to claim 17 wherein the angled outer segments form tangential arcs that comprise an average tangential angle of from about 5° to about 60°.

22. A polishing pad according to claim 17 wherein the main radial-line channels comprise a plurality of angled interior segments that comprise angles relative to each other of from about 2 to about 45°.

23. A chemical mechanical apparatus comprising the polishing pad of claim 17, and further comprising:

(i) a polishing station comprising a platen to hold the polishing pad and a support to hold a substrate against the polishing pad;

(ii) a slurry dispenser to dispense slurry on the polishing pad; and (iii) a polishing motor to drive at least one of the platen and support to oscillate the polishing pad and substrate against one another.

24. A method of fabricating the polishing pad of claim 17, the method comprising:

(a) cutting material from the polishing surface to form the main and tributary radial-line channels, wherein the material is cut at a cutting speed that is sufficiently high to heat the material in the main and tributary radial-line channels to a temperature that melts the material and substantially seals off the bottom of the channels.

25. A chemical mechanical polishing pad comprising:

(a) a body comprising a polishing surface having a radius and central and peripheral regions, the polishing surface comprising:

(i) a plurality of main radial-line channels extending radially outwardly from the central to the peripheral region of the polishing surface, each main radial-line channel having an angled outer segment at the peripheral region that is directed at an angle relative to a radius of the polishing surface, wherein the length $L_1$ of the main-line radial channel, the length $L_2$ of the angled outer segment, and the angle $\alpha$ formed between the angled outer segment and main-line radial channel are selected such that the centripetal force $F_c$ acting on the polishing slurry in the angled outer segment is controlled to provide a desired flow rate of slurry through the channel, where $F_c=mv^2/r$, m is a mass of the slurry in the channel, v is the velocity of the slurry, and r is the average radial distance of the angled outer segment across the polishing pad.

26. A chemical mechanical polishing pad comprising:

(a) a body comprising a polishing surface having a radius and central and peripheral regions, the polishing surface comprising:

(i) a plurality of main radial-line channels extending radially outwardly from the central to the peripheral region of the polishing surface, each main radial-line channel having an angled outer segment at the peripheral region that is directed at an angle relative to a radius of the polishing surface, wherein the length $L_1$ of the main-line radial channel, the length $L_2$ of the angled outer segment, and the angle $\alpha$ formed between the angled outer segment and main-line radial channel are selected such that the centripetal force $F_c$ acting on the polishing slurry in the angled outer segment is balanced against an opposing force $F_o$ which acts on the slurry in the angled outer section of the channel to provide a desired flow rate of slurry through the channel, where $F_c=mv^2/r$, m is a mass of the slurry in the channel, v is the velocity of the slurry, and r is the average radial distance of the angled outer segment across the polishing pad, and $F_o=mr(d\theta/dt)^2\cos(\alpha-(\pi/2))$, where, $d\theta/dt$ is the angular velocity of the polishing pad, and $\alpha$ is the angle between the main-line radial channel and angled outer segment.

27. A polishing pad according to claim 25 further comprising a plurality of primary tributary radial-line channels that are each connected by an angled transition segment to a main radial-line channel, the primary tributary radial-line channels being spaced apart from the main radial-line channels.

28. A polishing pad according to claim 27 further comprising a plurality of secondary tributary radial-line channels each of which is connected by second angled transition segment to a primary tributary radial-line channel.

29. A polishing pad according to claim 28 wherein the length and branch point of the primary and secondary tributary radial-line channels are selected in relation to the speed of use of the polishing pad such that a uniform distribution of polishing slurry is provided across the polishing pad surface.

30. A polishing pad according to claim 28 comprising from 1 to 10 main radial-line, primary tributary radial-line, or secondary tributary radial-line channels across each 10 degree arc of the polishing surface.

31. A polishing pad according to claim 25 wherein the angled outer segments form tangential arcs that comprise an average tangential angle of from about 5° to about 60°.

32. A polishing pad according to claim 25 wherein the main radial-line channels comprise a plurality of angled interior segments that comprise angles relative to each other of from about 2 to about 45°.

33. A chemical mechanical apparatus comprising the polishing pad of claim 25, and further comprising:

(i) a polishing station comprising a platen to hold the polishing pad and a support to hold a substrate against the polishing pad;

(ii) a slurry dispenser to dispense slurry on the polishing pad; and (iii) a polishing motor to drive at least one of the platen and support to oscillate the polishing pad and substrate against one another.

34. A method of fabricating the polishing pad of claim 25, the method comprising:

(a) cutting material from the polishing surface to form the main radial-line channels, wherein the material is cut at a cutting speed that is sufficiently high to heat the material in the main radial-line channels to a temperature that melts the material and substantially seals off the bottom of the channels.

35. A polishing pad according to claim 26 further comprising a plurality of primary tributary radial-line channels that are each connected by an angled transition segment to a main radial-line channel, the primary tributary radial-line channels being spaced apart from the main radial-line channels.

36. A polishing pad according to claim 35 further comprising a plurality of secondary tributary radial-line channels each of which is connected by second angled transition segment to a primary tributary radial-line channel.

37. A polishing pad according to claim 36 wherein the length and branch point of the primary and secondary tributary radial-line channels are selected in relation to the speed of use of the polishing pad such that a uniform distribution of polishing slurry is provided across the polishing pad surface.

38. A polishing pad according to claim 35 comprising from 1 to 10 main radial-line, primary tributary radial-line, or secondary tributary radial-line channels across each 10 degree arc of the polishing surface.

39. A polishing pad according to claim 26 wherein the angled outer segments form tangential arcs that comprise an average tangential angle of from about 5° to about 60°.

40. A polishing pad according to claim 26 wherein the main radial-line channels comprise a plurality of angled interior segments that comprise angles relative to each other of from about 2 to about 45°.

41. A chemical mechanical apparatus comprising the polishing pad of claim 26, and further comprising:

(i) a polishing station comprising a platen to hold the polishing pad and a support to hold a substrate against the polishing pad;

(ii) a slurry dispenser to dispense slurry on the polishing pad; and (iii) a polishing motor to drive at least one of the platen and support to oscillate the polishing pad and substrate against one another.

42. A method of fabricating the polishing pad of claim 26, the method comprising:

(a) cutting material from the polishing surface to form the main radial-line channels, wherein the material is cut at a cutting speed that is sufficiently high to heat the material in the main radial-line channels to a temperature that melts the material and substantially seals off the bottom of the channels.

* * * * *